United States Patent [19]

Laverty et al.

[11] Patent Number: 4,582,583

[45] Date of Patent: Apr. 15, 1986

[54] CONTINUOUS STRIPE PLATING APPARATUS

[75] Inventors: Gerald C. Laverty, Sunnyvale; Lev G. Amusin, San Jose, both of Calif.

[73] Assignee: National Semiconductor Corporation, Santa Clara, Calif.

[21] Appl. No.: 679,158

[22] Filed: Dec. 7, 1984

[51] Int. Cl.[4] ..... C25D 17/00

[52] U.S. Cl. ..... 204/206; 204/224 R

[58] Field of Search ..... 204/206, 224 R

[56] References Cited

U.S. PATENT DOCUMENTS

| | | | |
|---|---|---|---|
| 3,746,630 | 7/1973 | Kosowsky | 204/224 R |
| 4,029,555 | 6/1977 | Tezuka | 204/28 |
| 4,220,506 | 9/1980 | Skurkiss | 204/206 |
| 4,378,283 | 3/1983 | Seyffert | 204/224 R |
| 4,409,924 | 10/1983 | Laverty | 204/224 R |

FOREIGN PATENT DOCUMENTS

| | | | |
|---|---|---|---|
| 2530673 | 7/1982 | France | 204/206 |

*Primary Examiner*—T. M. Tufariello

*Attorney, Agent, or Firm*—Michael J. Pollock; Paul J. Winters; Gail W. Woodward

[57] ABSTRACT

The plating apparatus (10) includes a pair of loop belts (20,21) rotating on two sets of pulleys, each set of pulleys including pulleys (11,12), to drive a strip (40) to be stripe plated past a translatingly movable electrolyte manifold (41) containing a series of electrolyte inlet and outlet slots (70,71) in its strip-facing surface. Electrolyte is sprayed from the inlet slots through apertures (24) in a back-up layer of at least one of the belts and through a slot (22) formed between belt segments. Vacuum or air pressure inlets (78,96) are provided at the ends of the manifold to prevent egress of electrolyte from the nip between the pairs of belts. One pulley of each set of pulleys is adjustable to tension the belt and an intermediate roller arrangement is included between each of the pulleys in each set to monitor the belt tension and provide sufficient frictional holding contact between the belts and the workpiece strip and desired sliding contact between the belts and the manifold surface.

21 Claims, 17 Drawing Figures

10
11
11a
12
12a
13
14
15
16
18
19
20
20a
20b
21
22
23
24
25
27
28
29
30
31
31a
31b
32
33
34
35
36
37
40
41
41a
41b
41c
42
43
43a
A
B
9
3

FIG. 4
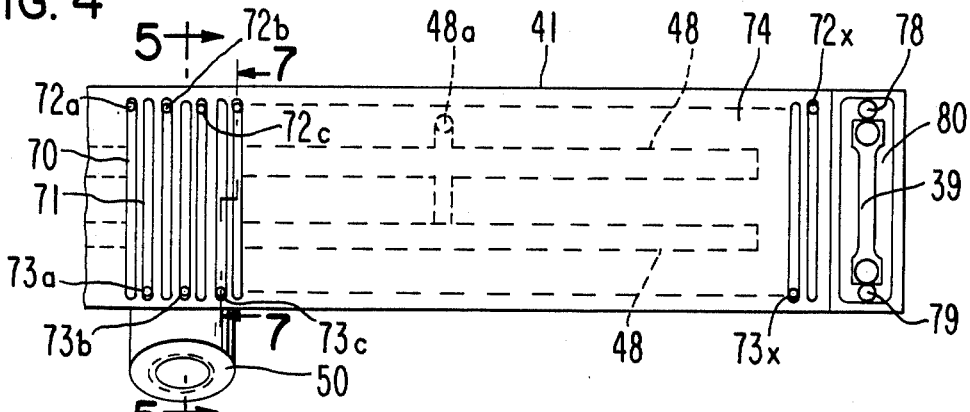
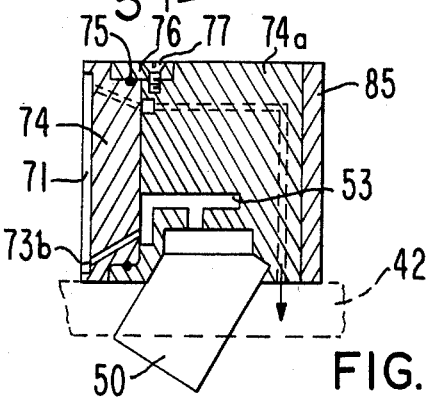
FIG. 5
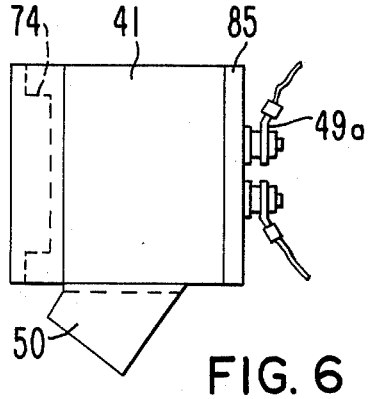
FIG. 6
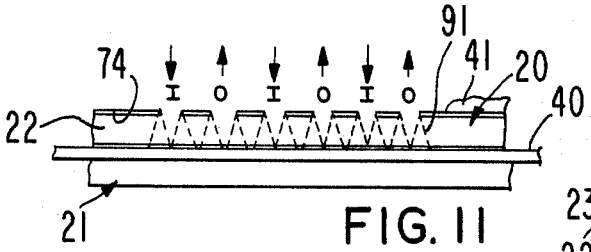
FIG. 11
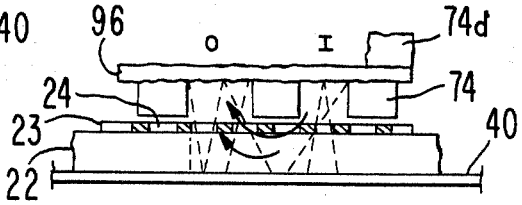
FIG. 15
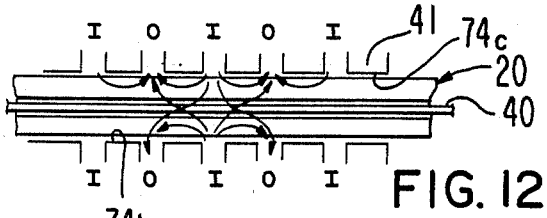
FIG. 12
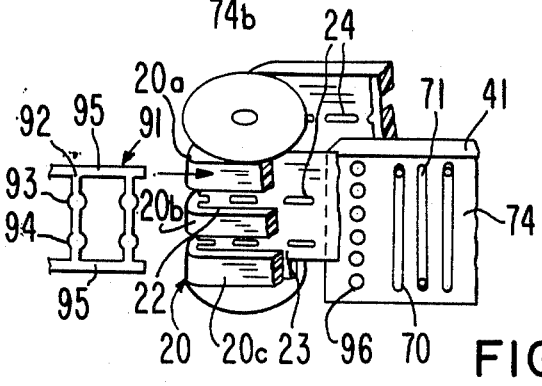
FIG. 14
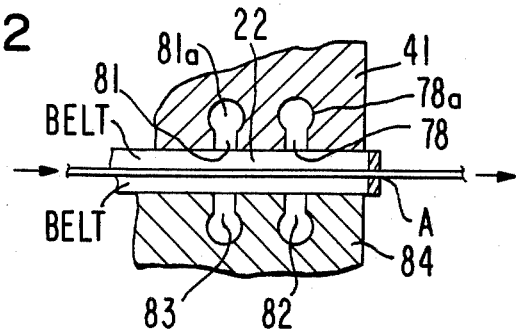
FIG. 13

FIG. 16
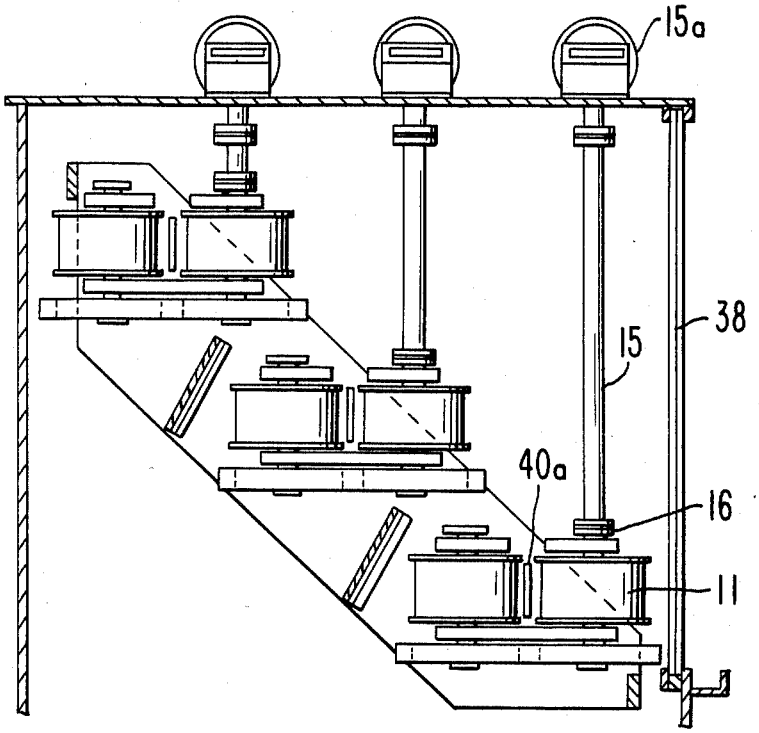
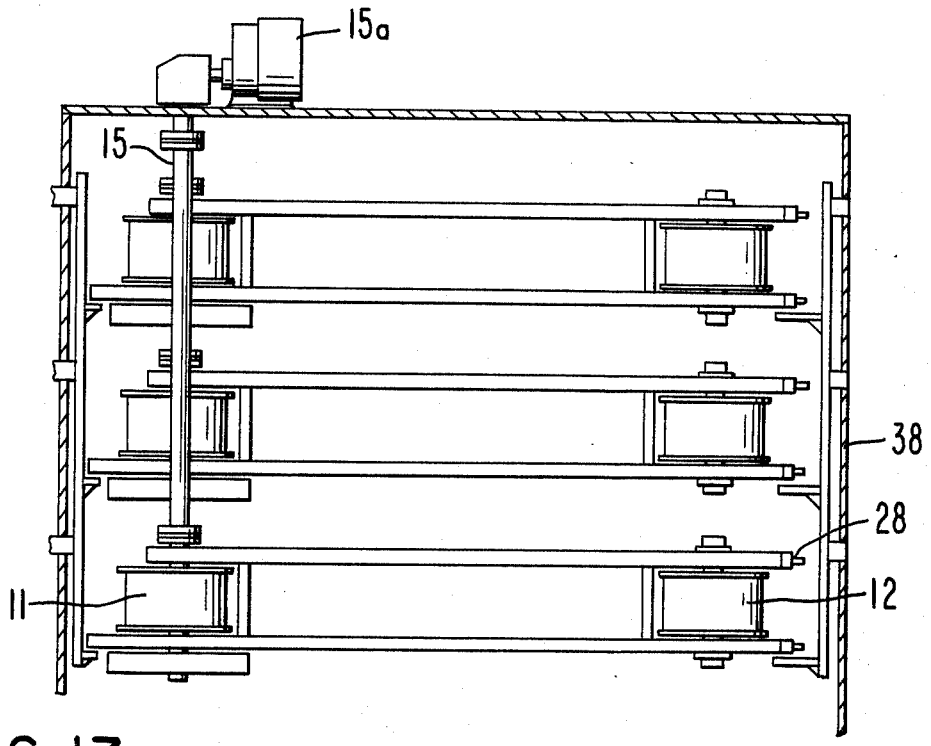
FIG. 17

CONTINUOUS STRIPE PLATING APPARATUS

BACKGROUND OF THE INVENTION

1. Field of the Invention

This invention relates to apparatus for the selective plating of repetitive surface portion(s), i.e., spots or stripes on continuous strip. The strip is advanceable continuously at a high velocity through a cell passing an anode and manifold in which a flowing electrolyte provides the metallic ions for plating. The apparatus is used to mask and plate conductive pads or the like on a workpiece strip.

2. Description of the Prior Art

So called "stripe plating" has been employed on metal or plastic strips, bonded connector pins and sockets and lead frames, individual increments of which are usable in making electrical or electronic parts or components. Plating cells which plate metal on strips and which are indexed or continuously moved as they unroll from a reel have been developed and sold. Typical of these are those cells seen in U.S. Pat. Nos. 4,029,555; 4,220,506; 4,378,283 (Seyffert and Laverty); 4,409,924 (Laverty et al.) and 3,746,630. U.S. Pat. Nos. 3,819,502; 3,855,108; 3,962,063; 3,986,945; and 4,036,725 utilize an insulatively-faced wheel over which a strip passes for plating. In indexing, i.e., step and repeat systems, it has been estimated that 30% of the time is taken in performing the indexing so that only 70% of the time is available for production. Thus continuous systems are advantageous.

The Robbins and Craig Company has developed a reel-to-reel automatic masking and plating cell system called Syncro-Plat III for plating one or more stripes of precious metal on one or both sides of a metal strip. This device operates at up to 30 feet per minute utilizing at least two moving belts each belt having belt segments spaced from each other to form a slot so that electrolyte can pass through the slot as the strip is being conveyed through the cell by the driving action of the belts in contact with the strip to be stripe plated. The belts have a metal back-up layer which is apertured, so that electrolyte from a fixed manifold passes through a series of holes in the manifold through the back-up layer apertures and belt slot(s) to the workpiece strip held between the belts. One or more manifolds fixed during operation are provided within the circumference of the driven belts which convey electrolyte to the strip surfaces to be plated. Spent electrolyte drains out the ends of the belt apparatus adjacent the strip entrance and exits between the pair of facing belts. Such belt system has been found advantageous over the wheel systems previously employed, in that the workpiece strip is "clamped" by and between facing moving belts so that the strip is not stretched or bent. This is particularly evident when plating thin metal foils or lace-like stamped or formed strips.

Various of the prior art devices cause slippage of the strip or unwanted drag or scraping of the strip as it passes through the plating station. These devices also generally suffer from electrolyte leakage, particularly the Syncro-Plat III device where electrolyte, either by design or seal failure, sprays out and causes a degree of undesirable plating or "discolor" on portions of the strip where no plating or contamination is desired. Likewise indexed devices oft times cause double plating thicknesses at certain portions of the strip. Some prior art cells are not operable with spliced strips.

SUMMARY OF THE INVENTION

The present invention is directed to improvements over the Syncro-Plat III system. A novel belt tensioning and slack monitoring arrangement is provided that particularly aids in the proper control of the belts driving the work piece strip through the plating station. A novel electrolyte supply and drain manifold, including a manifold head, is movable for sealing, feeding, and removal of electrolyte to and from the moving strip increment to be plated. It provides a slotted manifold head construction that minimizes leaking and spraying of electrolyte from between the sets of belts and from the belt slots at the belt ends and which removes electrolyte which might otherwise remain on the plated strip as it exits the apparatus.

Typically, the workpiece strip forms the charged cathode of the plating system and the manifold forms or contains the anode. The belts are faced with a resilient material, molded or slit, with material removed to make a slot where plating is to be performed. Electrolyte is sprayed through the slot onto the workpiece. A belt backing layer of flexible metal or plastic is provided which backing contains a series of elongated apertures which are in sliding engagement with a series of vertical slots on the facing surface of the manifold. Accurate plating results with little or no thickness variation of the plated metal. No unmasked areas are plated double thickness or left unplated as may happen in indexed systems. Novel end take-ups on each of the two sets of two pulleys (the Syncro-Plat III includes two sets of three separate pulleys), provide a smaller overall package width for the apparatus, allowing a smaller footprint for the electrolyte holding tanks. This narrower width facilitates stacking of plating cells for multi-strip lines. In one embodiment the apparatus may be 8" less in width.

The invention further allows an operator to more simply determine and monitor the slack and tension in the moving belts. Thus sealing of electrolyte is maximized while still providing for the sliding movement of the belt back-up layer over the manifold facing surface without excessive friction and wear. Heretofore, an operator has had to make sensitive hand adjustments to the third pulley position in the Syncro-Plat III system and could quite easily skew the pulleys resulting in uneven belt tensions, over-stretched belts, poor tracking of the belts or slipping of one or both belts used to drive the strips.

One of two manifolds is fixed in place contacting one of the two belts. The other manifold is provided with limited movement. The movable manifold is moved by and resiliently held by flexible air pressure tubes or air cylinders which allow the manifold and belt to move back off tight sealing contact with the workpiece strip if a splice, kink or other thickness discrepency is present on the strip being plated. Means are also provided in the manifold to prevent escape of electrolyte from slots in the belts onto the strip at the entrance and exit interface of the strip and belts. Electrolyte is either blown-off or vacuumed or by a combination of the two from the slots in the belts at the manifold ends to prevent leaking of the electrolyte, a common occurance in the Syncro-Plat III system causing spurious plating or immersion plating of the workpiece strip.

BRIEF DESCRIPTION OF THE DRAWINGS

FIG. 4 is a front partial view of one embodiment of the manifold head.

FIG. 5 is a cross-sectional view of the manifold head taken on the line 5—5 of FIG. 4.

FIG. 6 is an end view of the manifold head.

FIG. 11 is a schematic drawing of electrolyte slot inlets and slot outlets in a manifold showing overlapping electrolyte ion patterns from the slot edges toward the workpiece strip.

FIG. 12 is a schematic drawing showing plating operations on both sides of a lace-like apertured strip workpiece utilizing dual belts and two facing manifolds.

FIG. 13 is a partial cross-sectional top view of a manifold head end showing pressure differential means to drain electrolyte and prevent electrolyte exiting from the manifold ends.

FIG. 14 is a schematic perspective partial view of electrolyte drain and leakage prevention means positioned to coact with multiple belt slots and a strip workpiece.

FIG. 15 is a schematic of a second embodiment of the manifold head where a guaze anode is positioned interiorly of the manifold slots.

FIG. 16 is a cutaway end view of a multi-line strip plating system in a common catch tank.

FIG. 17 is a cutaway front view taken from the right side of FIG. 16.

DETAILED DESCRIPTION

Figures 1, 2:
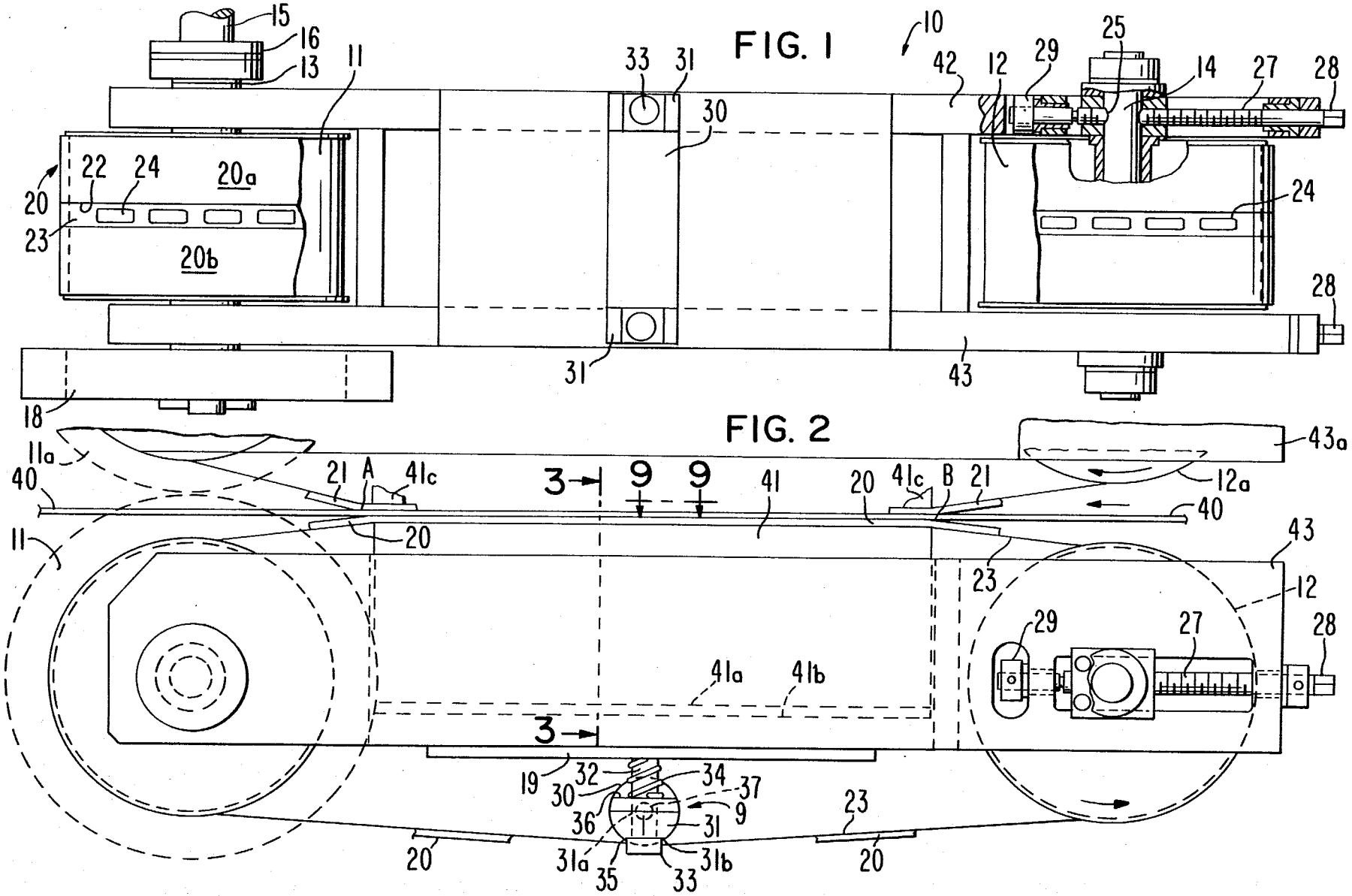
FIG. 1 is a partially cutaway front side view of one-half of the tension adjustable belt drive system.
FIG. 2 is a top view of the belt drive system showing the tension monitoring means.

FIG. 1 shows a cutaway front side view of one-half of the plating apparatus 10 which comprises a pair of pulleys 11 and 12 for holding and driving a looped belt 20. Looped belt 20 has a back-up layer 23 and two or more flexible bonded belt segments 20*a*, 20*b* having a slot 22 therebetween aligned with apertures 24 in the back-up layer. Pulley 11 is journaled in suitable bearings in plates 42, 43 and revolves with shaft 13. Shaft 13 is coupled to a shaft 15 by a coupling 16 and a gearmotor 15*a* (FIG. 17) drives shaft 15 to rotate pulley 11. Pulley 12 freely rotates on fixed shaft 14. Shaft 14 contains threaded apertures 25 which are positioned to receive jack screws 27 operable from the exterior of the apparatus by flat-sided posts 28 to translatingly move shaft 14 inward and outward with respect to the shaft 13. The ends of the jack screws 27 are held in frames 42, 43 by cross members 29. Movement of jack screws 27, by hand tool (or auxiliary motor) rotary movement of posts 28, moves shaft 14 in parallelism with respect to shaft 13, adjusting the tension on belt 20 extending between the pulley surfaces.

As can be seen in FIG. 2 (and FIG. 16) a second pair of pulleys 11*a*, 12*a* with another belt 21 therebetween, is positioned aside the assembly of FIG. 1 so that the facing surfaces of the belts, e.g., segments 20*a*, 20*b*, frictionally hold a workpiece strip between points A and B which has been inserted into the nip of belts 20 and 21 at point B. A tension monitoring means 9 functioning to provide the final tension on belts 20 and 21 is positioned generally midway between each set of pulleys. Each monitoring means includes a roller 30 journalled in end bearings 37 in bearing end housings 31. The end housings 31 contain apertures 31*a* through which pass pins 32 perpendicularly fixed to the plating apparatus frame 19. The end of each pin has a cap-end 33 which seats adjacent an outer flat 31*b* on each end housing 31. A tensioning spring 34 is positioned on pin 32 between the frame 19 and flats 36 on the end housings 31 surrounding pins 32. Thus the roller 31 is tensioned outwardly against the underside of belt 20 so that the back-up layer of the belt is in relative line contact with roller 31. When the posts 28 are adjusted so as to tension the belt 20 by outward movement of shaft 14 with respect to shaft 13, the tension of belt 20 against roller 30 toward manifold 41 acts to compress each spring 34 and move flats 31*b* away from the facing underside of pin caps 33, as shown by the arrow, forming gaps 35 therebetween. It has been found that a gap of approximately 0.03" is satisfactory for proper tensioning of the belts and such gap may be monitored by eye observation or by an optical sensor so as to determine that there is (1) proper frictional sliding contact between the underside of the belt (the back-up layer 23) and the facing surfaces of the manifold 41 and (2) sufficient frictional contact between the outer strip-facing surfaces of belt segments 20*a*, 20*b* and the workpiece strip 40 so as to frictionally hold and move the strip through the plating apparatus with the movement of the frictionally-engaged belts 20 and 21 on the facing sets of pulley assemblies.

Manifold 41 is moved toward fixed manifold 41*c* from positon 41*b* to position 41*a* for belt tensioning and for plating operations so as to seal the strip between belts and the belts to the facing surfaces of manifolds 41 and 41*c*. The above-described tensioning and monitoring system lessens the footprint of the apparatus, particularly by greatly diminishing the width of the overall apparatus in the direction of pin 32. Thus as seen in FIGS. 16 and 17 three or even four plating apparati may be stacked at various levels in or over a single plating catch tank and the operator can easily reach each for adjustment and monitoring purposes.

It is contemplated that the opposed assembly, i.e., pulleys 11*a*, 12*a* and belt 21, will likewise include a manifold therebetween and a tension monitoring means. However, if the workpiece strip is to be plated only on one side it is unnecessary that the facing assembly include a functioning manifold or a slotted belt. In such case, a belt 21 having an unslotted rubber belt portion and an unapertured back-up belt layer can be used which will functionally engage the back of the workpiece strip where no plating is desired, and a dummy manifold block utilized to provide a proper frictional force against the belt toward the workpiece. As in the FIG. 2 embodiment, the dummy block (or another functioning manifold if plating is desired on both sides of the workpiece strip) would be opposed to manifold 41 on the other side of the belts and strips at position 41*c*.

Figure 3:
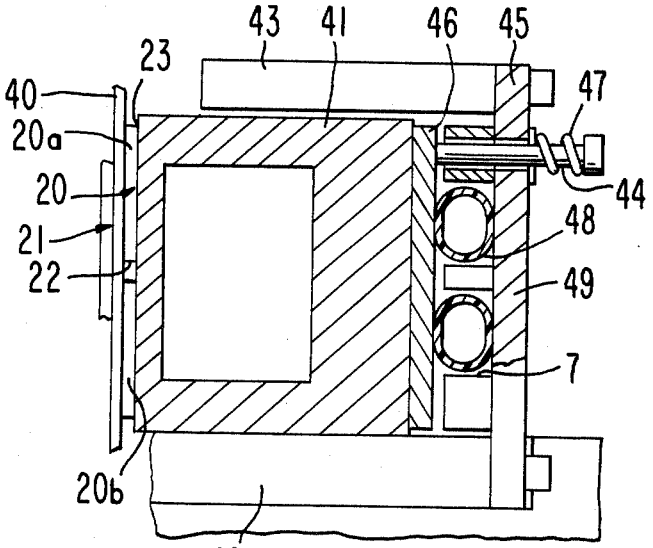
FIG. 3 is a cross-sectional end view of the movable electrolyte manifold taken on the line 3—3 of FIG. 2.

FIG. 3 shows the mechanism for moving the manifold 41 into a position against belt 20 and aligned with the workpiece strip 40 being conveyed by the belts 20, 21. Each of segments 20*a*, 20*b* of belt 20 are in frictional driving contact with the strip 40 while a normally metal or flexible plastic backing layer 23 of the belt is in sliding contact with the face of manifold 41, when manifold 41 is moved into the plating position from 41*b* to 41*a* (FIG. 2). The manifold 41 is moved by one or more pressurizing flexible rubber or plastic tubes 48 (or hydraulic or pneumatic pistons not shown) through inlet 48*a* (FIG. 8) with air or hydraulic pressure so they each expand simultaneously. The expanding tubes flexibly push against fixed plate 49 (connected to fixed frame plates 42 and 43) and move pusher plate 46 and the manifold 41 toward the belt 20 and the strip 40 and place the manifold 41 in operating position. The manifold 41 may flex rearward against tubes 48 if a thickened workpiece portion, such as a splice, passes the manifold. A fixed pin 44 is screwed into the rear of plate 46. Pin 44 has a head which abuts a compression spring 47 extending between the head and the rear of fixed plate 49 so that pusher plate 46 will be automatically returned to its non-operating position 41*b* (FIG. 2) upon release of the tube-expanding pressure within tubes 48. Tubes 48 act as an inflatable bladder and contain approximately 10 psi pressure. Fixed frame plates 42 and 43 may act as guideways for the moving manifold 41 so that the manifold face is positioned in parallelism with the belt and driven workpiece strip.

Belts 20, 21 contain a silicone rubber layer of approximately 0.125" in thickness and an apertured titanium or a stainless steel common backup layer of 0.010" thickness bonded by suitable adhesive or directly molded or vulcanized to the silicone rubber layer. The silicone rubber layer may be of a rubber of about 30 durometer.

FIG. 4 is a partial front view of the manifold face directly facing the apertured back-up layer of belt 20. Vertical slots 70 and 71 are provided extending alternately along the face and between the ends of the manifold face. Slot 70 represents an outlet slot and adjacent slot 71 represents an inlet slot. Each of the slots alternately have an outlet 72*a*, 72*b*, 72*c* at their top extremities in the outlet slots 70 and an inlet 73*a*, 73*b*, and 73*c* at their lower extremities in the inlet slots 71. An electrolyte main inlet 50 conveys electrolyte fluid into the interior of the manifold head where it then flows to the inlet openings 73*a*, 73*b*, 73*c* through 73*x*. The electrolyte flows up and out of the slots 71 through the apertures 24 (FIGS. 1, 9 and 14) in the backup portion of the belt and past the spaced edges of the belt segments 20*a*, 20*b* to plate those portions of the workpiece which are opposite the apertures in the backup belt and the belt slots. The belt edges of the slot acts to mask the workpiece. This results in a "stripe" plate or intermittent stripe if the strip is punched-out, across the total length of the workpiece strip (FIG. 10). The spent electrolyte passes back through passage 24 in belt to drain slots 70.

Vacuum or air pressure means may be provided at each end of the manifold 41 to prevent egress of electrolyte from the ends of the manifold which heretofore has been an unsealed area adjacent entrance and exit portions of the belts and workpiece strip. This means may comprise a vacuum or air pressure aperture 78 which either blows egressing electrolyte collected in collection slot 80 from air inlet 78 to drain 79 or where openings 78 and 79 are connected to a vacuum to suction electrolyte exiting from the manifold ends or off the exiting workpiece strip from the manifold. The slots 70, 71 are contained in the manifold face plate 74, which plate is held at its ends by a suitable bar 39 screwed into the manifold housing 74*a* (FIG. 5).

FIG. 5 is a cross-sectional view of the manifold showing the manifold face plate 74 having a series of vertical grooves or slots 71 therein on its outside facing surface and a bore outlet 73*b* leading from a plenum 53 connected to inlet 50. Manifold face plate 74 is suitably sealed with an O-ring 75 to the main casing of the manifold 74*a* and held in position by top lateral bar 76 and screws 77. A stiff nonmetallic pressure plate 85 is at the rear of the manifold.

FIG. 6 shows the manifold 41, manifold face plate 74, and electrical connections 49*a* to serve as the source of anodic current through plate 85, the main body of the manifold 41 to the face plate 74. The area surrounding the slots 70 and 71 in FIGS. 4 and 5 are anodic opposing the cathodic workpiece strip which is passing juxtaposed and spaced therefrom.

Figure 7:
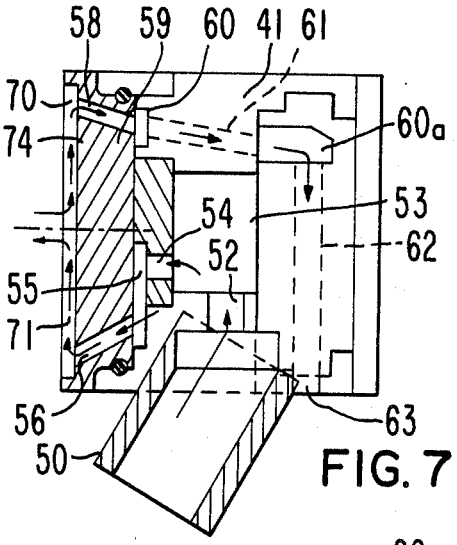
FIG. 7 is a cross-sectional view of the manifold head taken on the line 7—7 of FIG. 4.

FIG. 7 shows the interior of a preferred construction of the manifold wherein a vertical inlet slot 71 on the manifold face plate 74 is in flow communication with inlet opening 56. In this view the lower half of inlet slot 71 and the upper half of outlet slot 70 is seen. Electrolyte is pumped into the manifold through inlet 50, passes through a first plenum 51, through a plurality of bores 52 to a second plenum 53 where the electrolyte passes through a second plurality of bores 54 to an inlet plenum 55. Inlet plenum 55 is in flow communication with each of the inlet bores 56 which end at the lower bottom of each of grooves 71. The flow of electrolyte is shown by the arrows, the horizontal outward arrows representing the flow through apertures 24 and the slot between the belts. Thus increments of plating material are placed on aligned linear increments of the strip passing through the plating apparatus by the latter electrolyte flow and ion deposition. Used electrolyte passes along the belt slot and out the back-up layer apertures 24 into adjacent vertical outlet slots 70 in the manifold face plate 74 as seen by the inward horizontal arrows through outlet bore 58 at the top of slot 70 and into outlet plenums 60, 60*a* bores 61 and 62 to an outlet 63.

Figure 8:
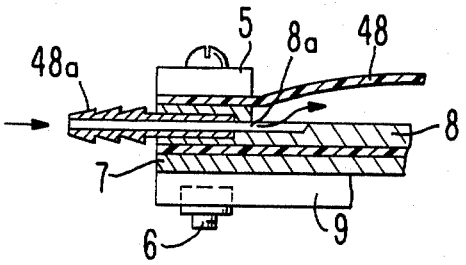
FIG. 8 is a partial side view of the air inlet for the tubes of FIG. 3.

FIG. 8 shows a detail of a means for clamping an air inlet to tubes 48 at an end of the manifold. A tube end is provided with a plastic insert 8 having a channelled-end 8*a*, a barbed inlet nipple 48*a* inserted into the tube end abutting insert 8 and a plastic cradle 7 placed along the tube 48 to support the tube along its contours. Clamp bars 5, 9 and bolts 6 compressibly hold and seal the tube end, nipple, insert and cradle. The opposite ends of tube 48 may be similarly sealed, omitting nipple 48*a*.

Figure 9:
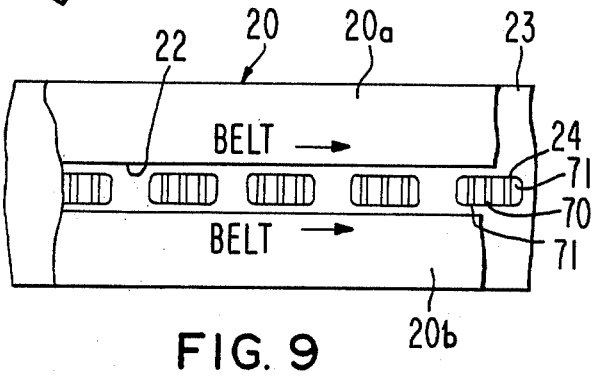
FIG. 9 is a partial view as seen from the workpiece location toward one of the drive belts and one manifold, taken in the direction and over the area 9—9 in FIG. 2.
Figure 10:
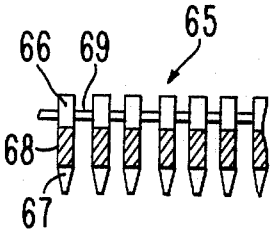
FIG. 10 illustrates a typical connector strip as it emerges from plating by the apparatus.

FIG. 9 represents a view in FIG. 2 from the strip to be plated. That strip "sees" the belt segments 20*a* and 20*b* and slot 22 and is driven in frictional contact with the outer surfaces of those segments along with the belt on the opposite side of the strip. At the same time the common belt back-up layer 23, containing apertures 24, allows electrolyte to pass from slots 71 in the manifold face plate 74 through the apertures 24 to the desired incremental surfaces of the workpiece strip with the remainder of the belt segments 20*a* and 20*b* acting to mask the remainder of the strip. Spent electrolyte is exhausted through the next adjacent outlet slots 70 in the manifold face plate 74.

A typical workpiece strip is seen in FIG. 10 wherein contact fingers 66 and 67 are separated by an area 68 that is aligned with the slot 22 in FIG. 9 and which upon passing through the plating apparatus is plated with a gold or other metal stripe of the width of slot 22 to normally form a conductive pad or the like. Each of the contacts 66, 67 and 68 are connected by a frangible link 69 to succeeding and repetitive contacts. In the final assembly of a semiconductor package or other electrical component, for example, the links 69 are broken or excised so that a plated contact or series of contacts may be included in the package or component.

FIG. 11 schematically represents the functioning of the inlet and outlet slots 71, 70 in manifold face plate 74 of manifold 41. Inlets (I) provide electrolyte which is pressurized out and through the slots 22 between the belt segments 20*a* and 20*b* returning through slots 22 to outlet (O) slots 70. Electrons from the strip 40 flow to the edges of the anode areas of face plate 74 conducting in a fan-like pattern 91, each fan-like pattern intersecting with a fan-like pattern from an adjacent anode edge. In this Figure only one edge of slot 22 representing the slot 22 between the belt segments 20*a*, 20*b* is shown. The electrolyte is collected in the adjacent manifold outlet slots (O) and removed from the area. The belt back-up layer 23 slides in contact with the manifold facing surfaces surrounding the manifold slots, while the belt segments 20*a*, 20*b* frictionally engages and moves the strip 40 through the plating apparatus with belt 21 on the opposite side of the strip, without stretching or pulling of the strip.

FIG. 12 schematically illustrates an embodiment wherein two operating manifold face plates 74*c*, 74*b* are utilized having opposed inlet (I) and outlet (O) apertures in their respective slots extending vertically on the facing surfaces. As can be seen, perforated strip 40 is held between the belts 20, 21 and all three pass the two manifold faces 74*c* and 74*b*. The strip is spaced from the manifold faces by the thickness of each belt 20 and 21. As can be seen by the arrows, the electrolyte enters from inlets (I) into the slots 22 between belt segments 20*a*, 20*b* through the back-up layer apertures 24 on each belt. plating is accomplished, and spent electrolyte is able to exit either into an outlet (O) in its own manifold face or into an outlet (O) in the opposing manifold face through the lace-like openings in the workpiece strip. This results in considerable agitation to allow optimal plating performance.

FIG. 13 illustrates a partial view of an end portion of the manifold in which a series of apertures 78, 81, 82 and 83 extend from the edge portions of the manifold. These openings are connected to a source of vacuum through bores 78*a* or 81*a* or to an air pressure source so as to suction or blow exiting electrolyte off of the strip 40 and in slot 22 to prevent egress of the electrolyte from the points A and B shown in FIGS. 2 and 13.

FIG. 14 shows a construction in which three spaced belt segments 20*a*, 20*b* and 20*c* are placed on belt back-up layer 23. As shown, workpiece strip 91 has contact areas 93 and 94 which when passed into the nip of adjacent belts 20 and 21 have their rear surfaces captured by the outer surfaces of belt segments 20*a*, 20*b* and 20*c* in frictional driving contact. Areas 93 and 94 are aligned with the masking slots 22 between the belt segments and with the back-up layer apertures 24. Thus as the strip 91 spacedly passes in front of the face 74 of manifold 41 (travelling traverse to vertical slots 70 and 71), the electrolyte traverses slots 71 upwardly and outwardly, passes through the apertures 24 and slot 22 so that an even thickness of stripe is plated progressively on each of the surfaces 93 and 94 as the strip held by the moving belts 20, 21 passes the multiple vertical slots in the nozzle block of the manifold. The belts and workpiece strip may pass the manifold surface at rates of from 30 to 60 feet per minute.

It has been found that apertures 24 should be spaced from each other to give a web distance less than one times the thickness of the belt in order to obtain proper coverage of the areas to be plated on the particular workpiece passing through the plating apparatus. Vacuum apertures 96 may be positioned at the end of the manifold 41 to vacuum electrolyte leading from slot 70 or which otherwise would spray out of slot 22 at the belt ends as they turn on the pulleys.

FIG. 15 illustrates an alternative embodiment where a platinum gauze layer 96 is provided between a non-conducting manifold face plate 74 and back-up plate 74*d* mounted to manifold 41. Anodic current is passed to the gauze and the path of plating ions (dashed lines) is from the gauze at the bottom of the inlets and outlets in the manifold vertical slots, through the belt apertures 24 and belt slot 22 to the workpiece strip 40. Spent electrolyte moves from an inlet slot (I) to an outlet slot (O) as the metallic ions are plated on the moving strip.

FIGS. 16 and 17 show a series of three plating lines staggered in a plating catch tank 38. Each line comprising dual sets of pulleys over which belts (not shown) rotate and through which the workpiece strip passes. Tank 38 contains rubber-sealed openings 40*a* through which the strip enters the tank. As can be seen in FIG. 16 shortening the horizontal width of each of the two parallel sets of pulleys and belts allows the stacking of three strip plating lines in a relatively narrow width of tank.

While not forming part of this invention, the electrolyte may typically be any plating solution such as gold cyanide or tin-lead solution. Normally the electrolytes are at a pH of about 3.0 to about 6.5. The amount of charge on the strip is dependent on the size of the strip, the current capacity of the electrolyte and the area of plating desired.

Apertures 24 may be approximately 7/8" in length with the web betwen each aperture being approximately $\frac{1}{8}$" in length for a belt 1/7" or more thick. The manifold face plate 74 may be made of conductive vitreous carbon which is a highly crystalline material, hard as glass, over which the titanium or metal backup belt can easily slide over with a low coefficient of friction. In such event, anode gauze is not needed. When anode gauze is used the manifold may be made of ultra high molecular weight polyethylene, Teflon or similar low coefficient dielectric material.

The above description of embodiments of this invention is intended to be illustrative and not limiting. Other embodiments of this invention will be obvious to those skilled in the art in view of the above disclosure.

We claim:

1. A plating apparatus for plating linear increments of a movable workpiece strip comprising:

at least one pair of movable loop belts to move a to-be-plated continuous strip, said belts being spaced from each other in their direction of travel to be in frictional driving contact with said strip to drive the strip, at least one of said belts having spaced linear segments forming a masking slot therebetween;

each of said pair of belts being mounted on and extending in a tensioned span between first and second spaced pulleys each on a rotary shaft;

drive means connected to the shaft of said first pulley for rotatively driving said first and second pulleys;

adjusting means connected to the second pulley for adjusting the span between said pulleys and tension in said belts;

an electrolyte manifold, extending between said pulleys within the loop of at least one of said belts and movable with respect to said strip into rubbing contact at a prescribed pressure with said one belt, said manifold including a manifold head having multiple slots extending transverse to said moving strip to convey plating electrolyte from said manifold through said masking slot to linear increments of said moving strip facing said masking slot for incrementally plating said increments; and means in contact with said belts between said pulleys for monitoring the tension of said belts to provide a sufficient frictional driving force of said belts in contact with said strip to move said strip.

2. The apparatus of claim 1 in which said adjusting means comprises jack screw means operable for moving the shaft of said second pulley linearly with respect to the shaft of the first pulley.

3. The apparatus of claim 1 in which said means for monitoring comprises:

a pair of fixed pins each including cap ends extending from a fixed frame positioned interiorly of said belts;

a roller extending between said pins and in engagement with said belts;

bearing end housings for supporting said roller; and tension spring means extending between said frame and said bearing end housings for tensioning said belts outwardly from a centerline between said pulleys, said second pulley adjusting means being adjusted such that a predetermined gap is formed between said bearing end housings and said cap ends.

4. The apparatus of claim 3 in which said bearing end housings and said roller translates on said fixed pins dependent on the net tensioning force of said tension spring means and the tensioning of said belts by said adjusting means.

5. The apparatus of claim 1 in which said vertical head slots alternately form electrolyte inlet slots and electrolyte outlet slots.

6. The apparatus of claim 5 in which each of said inlet slots and each of said outlet slots respectively include an electrolyte inlet opening and an electrolyte outlet opening, said inlet openings being at one location in said inlet slots and said outlet openings being at another location in said outlet slots, said outlet openings locations being displaced transversely with respect to said inlet openings locations.

7. The apparatus of claim 6 in which said inlet openings are at a one end of said inlet slots and said outlet openings are at the other end of said outlet slots.

8. The apparatus of claim 1 wherein said belts include a backing layer extending across the belt segments, said backing layer having linearly-extending apertures aligned with said masking slot between said belt segments, each of said apertures being separated by a connecting web, edges of said apertures and said webs being in sliding contact with said manifold head.

9. The apparatus of claim 8 wherein the connecting web has a length less than the thickness of the belt.

10. The apparatus of claim 1 further comprising means in said manifold, adjacent strip entrance and exit locations of said belts for draining and collecting spent electrolyte from said belt slot and said strip at said entrance and exit locations.

11. The apparatus of claim 10 wherein said means for draining comprises differential air pressure means for removing electrolyte from said belt slot and strip.

12. The apparatus of claim 1 including flexible air pressure tubes expandible by air pressure to move and resiliently hold said manifold against said belts.

13. A plating apparatus for plating linear increments of a movable strip comprising:

at least one pair of movable loop belts to move a to-be-plated continuous strip, said belts being spaced from each other in their direction of travel to form a slot therebetween and to be in frictional driving contact with said strip to drive the strip;

each of said pair of belts being mounted on and extending in a tensioned span between first and second spaced pulleys each on a rotary shaft;

drive means connected to the shaft of said first pulley for rotatively driving said first and second pulleys; and an electrolyte manifold extending between said pulleys and flexibly movable with respect to said strip so that at least one of said belts is in rubbing contact therewith, said manifold including a manifold head having multiple slots extending transverse to said moving strip to convey plating electrolyte from said manifold through said belt to said moving strip.

14. The apparatus of claim 13 in which said transverse manifold slots alternately form electrolyte inlet slots and electrolyte outlet slots.

15. The apparatus of claim 13 in which each of said inlet slots and each of said outlet slots respectively include an electrolyte inlet opening and an electrolyte outlet opening, said inlet openings being at one location in said inlet slots and said outlet openings being at another location in said outlet slots, said outlet openings locations being displaced transversely with respect to said inlet openings locations.

16. The apparatus of claim 13 wherein at least one of said belts include a backing layer extending across the belt, said backing layer having linearly-extending apertures aligned an elongated slot between linear portions of said belt, each of said apertures being separated by connecting webs, with the edges of said aperture and said webs being in sliding contact with said manifold head extending between said manifold slots.

17. The apparatus of claim 13 further comprising means in said manifold, adjacent entrance and exit locations of said strip with said belts for draining and collecting spent electrolyte from said belts and said strip at said locations.

18. The apparatus of claim 13 including flexible air pressure tubes expandible by air pressure to move and resiliently hold said manifold against said moving belts.

19. The apparatus of claim 13 wherein said strip is cathodic and said manifold head is anodic.

20. The apparatus of claim 19 in which said manifold head is made of electrically conductive vitreous carbon.

21. The apparatus of claim 13 wherein multiple plating apparatus as set forth are staggered at various levels in a plating catch tank.

* * * * *